US012799863B1

(12) United States Patent
Marongiu Porcu et al.

(10) Patent No.: US 12,799,863 B1
(45) Date of Patent: Nov. 17, 2026

(54) DETERMINING GROUPINGS OF TWO OR MORE BOREHOLES

(71) Applicant: NexTier Completion Solutions Inc., Houston, TX (US)

(72) Inventors: Matteo Marongiu Porcu, Houston, TX (US); Elias Pirayesh, Houston, TX (US); Otman Abdulkarim Algadi, Fulshear, TX (US)

(73) Assignee: Nextier Completion Solutions, Inc., Houston, TX (US)

( * ) Notice: Subject to any disclaimer, the term of this patent is extended or adjusted under 35 U.S.C. 154(b) by 534 days.

(21) Appl. No.: 17/707,559

(22) Filed: Mar. 29, 2022

Related U.S. Application Data

(60) Provisional application No. 63/167,457, filed on Mar. 29, 2021.

(51) Int. Cl.
*E21B 49/00* (2006.01)
*E21B 43/11* (2006.01)
*E21B 43/26* (2006.01)

(52) U.S. Cl.
CPC ..... *E21B 49/00* (2013.01); *E21B 43/11* (2013.01); *E21B 43/261* (2013.01)

(58) Field of Classification Search
CPC ..... E21B 49/00; E21B 43/11; E21B 43/261
USPC ..... 702/6
See application file for complete search history.

(56) References Cited

U.S. PATENT DOCUMENTS 10,837,277 B2 11/2020 Logan
2016/0017696 A1* 1/2016 Srinivasan ..... E21B 43/00 703/10
2017/0114616 A1* 4/2017 Enkababian ..... E21B 43/16
2018/0038226 A1* 2/2018 Logan ..... E21B 49/00
2020/0190961 A1* 6/2020 Moss, Jr. ..... E21B 3/02
(Continued)

FOREIGN PATENT DOCUMENTS

WO 2019/157336 A1 8/2019

OTHER PUBLICATIONS

Teale, R., "The Concept of Specific Energy in Rock Drilling", Int. J. Rock Mech. Mining Sci., 1965, vol. 2., pp. 57-73, Pergamon Press.
(Continued)

*Primary Examiner* — Andrew Schechter
*Assistant Examiner* — Joshua L Forristall
(74) *Attorney, Agent, or Firm* — Phelps Dunbar LLP; R. Andrew Patty, II; Mary H. Drabnis

(57) ABSTRACT

One or more methods are described for grouping two or more boreholes, and along with related systems and computer readable media. The method can include obtaining mechanical specific energy (MSE) values for each of a plurality of boreholes traversing one or more geological formations, grouping two or more boreholes of the plurality of boreholes based on MSE values, and determining one or more parameters of a well completion scenario for at least a portion of the first and second boreholes, based on the group on of boreholes. Also provided herein are one or more computer readable media having computer executable instructions that, when executed by at least one processor, cause the processor to the above method. Still further provided herein are one or more systems including at least one processor and the above computer readable media.

6 Claims, 10 Drawing Sheets

(56) References Cited

U.S. PATENT DOCUMENTS

| | | | | |
|---|---|---|---|---|
| 2023/0211307 | A1* | 7/2023 | Feng et al. | D21H 21/54<br>436/171 |
| 2024/0060419 | A1* | 2/2024 | Rodriguez et al. | E21C 39/00 |

OTHER PUBLICATIONS

Logan, William D. et al.; "An Evaluation of Engineered Completions Based on Mechanical Specific Energy"; Apr. 2017, AADE-17-NTCE-059; American Association of Drilling Engineers, National Technical Conference and Exhibition, Houston, Texas, USA; 9 pages.

Logan, W.D.; "Engineered Shale Completions Based on Common Drilling Data"; JPT (Society of Petroleum Engineers), Sep. 2016; pp. 86-88.

Logan, W.D.; "Engineered Shale Completions Based on Common Drilling Data"; Sep. 2015, SPE-174839-MS, Society of Petroleum Engineers, Annual Technical Conference and Exhibition, Houston, Texas, USA; 15 pages.

Jacobs, Trent; "To Spark Real-Time Revolution, Fracture Diagnostic Firms Partner Up and Innovate"; JPT (Society of Petroleum Engineers), Oct. 2019, pp. 32-39.

* cited by examiner

| COLOR INDEX REFERENCE | | | |
|---|---|---|---|
| COLOR | HARDNESS | MSE (KSI) | ROCK HARDNESS INCREASES |
| YELLOW | HD1 | 0 - 15 | |
| ORANGE | HD2 | 15 - 30 | |
| READ | HD3 | 30 - 50 | |
| DARK BLUE | HD4 | 50 - 75 | |
| PURPLE | HD5 | 75 - 100 | |
| LIGHT BLUE | HD6 | 100 - 125 | |
| PLUM | HD7 | 125 - 150 | |
| MAGENTA | HD8 | 150 - 175 | |
| SEA GREEN | HD9 | 175 - 250 | |
| DARK GREEN | HD10 | 200 - 225 | |
| LIGHT PURPLE | HD11 | 225 - 250 | |
| TEAL | HD12 | 250 - 300 | |
| PINK | HD13 | 300 - 400 | |
| DARK PURPLE | HD14 | 400 - 500 | |

FIG. 2

DETERMINING GROUPINGS OF TWO OR MORE BOREHOLES

CROSS REFERENCE TO RELATED APPLICATION

This application claims priority from U.S. Application No. 63/167,457, filed Mar. 29, 2021, the disclosure of which is incorporated herein by reference in its entirety.

FIELD

The present disclosure relates to methods for grouping two or more boreholes and related systems, and more specifically to methods for grouping two or more boreholes based on MSE values and determining a well completion scenario for at least a portion of two or more boreholes based on the grouping.

BACKGROUND

This section introduces information that may be related to or provide context for some aspects of the techniques described herein and/or claimed below. This information is background facilitating a better understanding of that which is disclosed herein. Such background may include a discussion of "related" art. That such art is related in no way implies that it is also "prior" art. The related art may or may not be prior art. The discussion is to be read in this light, and not as admissions of prior art.

Various methods and systems for completing one or more wells traversing a geological formation are known in the art. For example, hydraulic fracturing is a technique for fracturing a geological formation with a pressurized liquid. The hydraulic fracturing process can involve injecting fluid under high pressure into a borehole to fracture the rock of the geological formation. The liquid propagates throughout the fractures. When the liquid is removed, the fractures stay open because proppants (e.g., naturally occurring sand grains, specially engineered proppants such as resin-coated sand, high-strength ceramic materials like sintered bauxite) suspended in the fracturing fluid remain in the fractures and keep the fractures from closing. The open fractures can provide greater access to natural resources contained in a geological formation (e.g., liquid petroleum and natural gas) thereby allowing such natural resources to flow easier within the geological formation to the borehole for recovery at the ground surface.

One such hydraulic fracturing technique described in International Publication No. WO 2019/157336 A1 involves the simultaneous fracturing of two boreholes in a geological formation to extract natural resources by creating a fracture network in a target geological formation by simultaneously pressurizing the geological formation on opposing sides with hydraulic fracturing liquid through different boreholes thereby creating a series of fractures from each of the different boreholes with effective fracture lengths that overlap with each other. Such a technique can result in a significant reduction of completion times.

However, for a multi-well pad including a plurality of boreholes, each respective borehole traversing one or more geological formations can exhibit significantly different rock properties relative to another borehole drilled from or near the same pad. The selection and grouping of boreholes for well completions operations (e.g., simultaneous hydraulic fracturing) are generally done in a random, sequential or alternate manner that does not take into consideration possible differences in rock properties among the boreholes. Such differences can significantly impact simultaneous fracturing treatments, thereby causing a variety of problems such as limited injectivity, disproportionate treatment proppant flow split, overstimulation, under stimulation, screenouts, all of which can increase costs and completion times.

Thus, there is a need for new and improved methods and systems that minimize or reduce the impact from the above and other limitations.

Non-Limiting Summary

In general, the present disclosure provides one or more methods and related systems for grouping two or more boreholes based on MSE values and determining a well completion scenario for at least a portion of two or more boreholes based on the grouping.

In an aspect, a method is provided. The method includes obtaining mechanical specific energy (MSE) values for each of a plurality of boreholes traversing one or more geological formations, grouping two or more boreholes of the plurality of boreholes based on MSE values in which at least a portion of a first borehole of the plurality of boreholes is grouped with at least a portion of at least a second borehole of the plurality of boreholes, and determining one or more parameters of a well completion scenario for at least a portion of the first and second boreholes, wherein the well completion scenario is based at least in part on the grouping of two or more boreholes of the plurality of boreholes based on MSE values.

One or more aspects include the method of the preceding paragraph in which the MSE values are obtained by calculating MSE based on drilling data for the plurality of boreholes.

One or more aspects include the method of any preceding paragraph in which the grouping of two or more boreholes is at least in part based on grouping the portions of the first borehole and second borehole having the same or similar MSE values as determined by a mapping of the MSE values of the one or more geological formations traversed by the first and second boreholes. In some implementations, the mapping of MSE values includes (a) categorizing the MSE values for each respective portion of the boreholes into a plurality of groups according to different ranges of MSE values in which the different ranges of MSE values represent different facies of rock, and (b) mapping groups to which the MSE values are categorized with locations along the portions of each respective borehole that are associated with the MSE values.

One or more aspects include the method of any preceding paragraph in which the grouping of two or more boreholes is at least in part based on grouping the portions of the first and second borehole having the same or similar MSE values as determined by one selected from the group consisting of MSE average values, MSE standard deviation, MSE variance, MSE median, shape of the cumulative MSE distribution curve, and any combination of two or more of the foregoing.

One or more aspects include the method of any preceding paragraph in which the grouping of two or more boreholes is at least in part based on a grouping of the portions of the first and second borehole having the same or similar MSE values as determined by a quantitative statistical analysis of the MSE values of the one or more geological formations traversed by the first and second boreholes. In some implementations, the quantitative statistical analysis can include a cluster analysis as performed with a cross-plot of MSE variance versus MSE Median.

One or more aspects include the method of any preceding paragraph in which the grouping of two or more boreholes is at least in part based on a grouping of the portions of the first and second borehole having the same or similar MSE values as determined by a granular assessment of the MSE values of the one or more geological formations traversed by the first and second boreholes. In some implementations, the granular assessment includes (a) categorizing the MSE values of each respective borehole into a plurality of groups according to different ranges of MSE values in which the different ranges of MSE values represent different facies of rock, and (b) comparing the groups to which the MSE values are categorized with locations along portions of each respective borehole which are associated with the MSE values so as to group particular portions of each respective borehole with one another.

One or more aspects include the method of any preceding paragraph in which the method includes completing or recompleting a plurality of wells based on the well completion scenario. In some implementations, the completing or recompleting of each of the plurality of wells occurs simultaneously or substantially simultaneously.

One or more aspects include the method of any preceding paragraph in which the well completion scenario includes positioning at least one perforation cluster at a location along each respective borehole having the same or substantially similar facies as defined by the grouping of MSE values. In some implementations, the method also includes perforating at least a portion of each respective borehole based on the well completion scenario.

One or more aspects include the method of any preceding paragraph in which the well completion scenario includes determining a hydraulic fracturing fluid initiation pressure for at least a portion of each respective borehole.

One or more aspects include the method of any preceding paragraph in which the well completion scenario includes selecting a proppant for use in at least a portion of each respective borehole.

One or more aspects include the method of any preceding paragraph in which the well completion scenario includes positioning at least one fracture plug at a location along each respective borehole.

One or more aspects include the method of any preceding paragraph in which the well completion scenario includes selecting a hydraulic fracturing fluid for use in at least a portion of each respective borehole, and using the hydraulic fracturing fluid in a hydraulic fracturing process.

One or more aspects include the method of any preceding paragraph in which the method includes fracturing at least a portion of the first borehole, the second borehole, or both of the foregoing.

In another aspect, a non-transitory computer-readable medium is provided. The non-transitory computer-readable medium has computer executable instructions that, when executed by at least one processor, cause the processor to perform a method as defined by any preceding paragraph.

In still another aspect, a system is provided. The system includes at least one processor, and one or more tangible non-transitory computer readable storage media upon which is encoded machine-readable code that when executed is configured so that the system carries out a method as defined by any preceding paragraph.

While multiple embodiments are disclosed, still other embodiments will become apparent to those skilled in the art from the following detailed description. As will be apparent, certain embodiments, as disclosed herein, are capable of modifications in various obvious aspects, all without departing from the spirit and scope of the claims as presented herein. Accordingly, the drawings and detailed description are to be regarded as illustrative in nature and not restrictive.

BRIEF DESCRIPTION OF THE DRAWINGS

For a detailed description of the preferred embodiments of the disclosed embodiments, reference will now be made to the accompanying drawings in which:

FIG. 2 illustrates a table categorizing MSE values for one or more boreholes into a plurality of groups according to different ranges of MSE values in which the different ranges of MSE values represent different facies of rock in accordance with certain aspects of the subject matter described herein.

Figure 1:
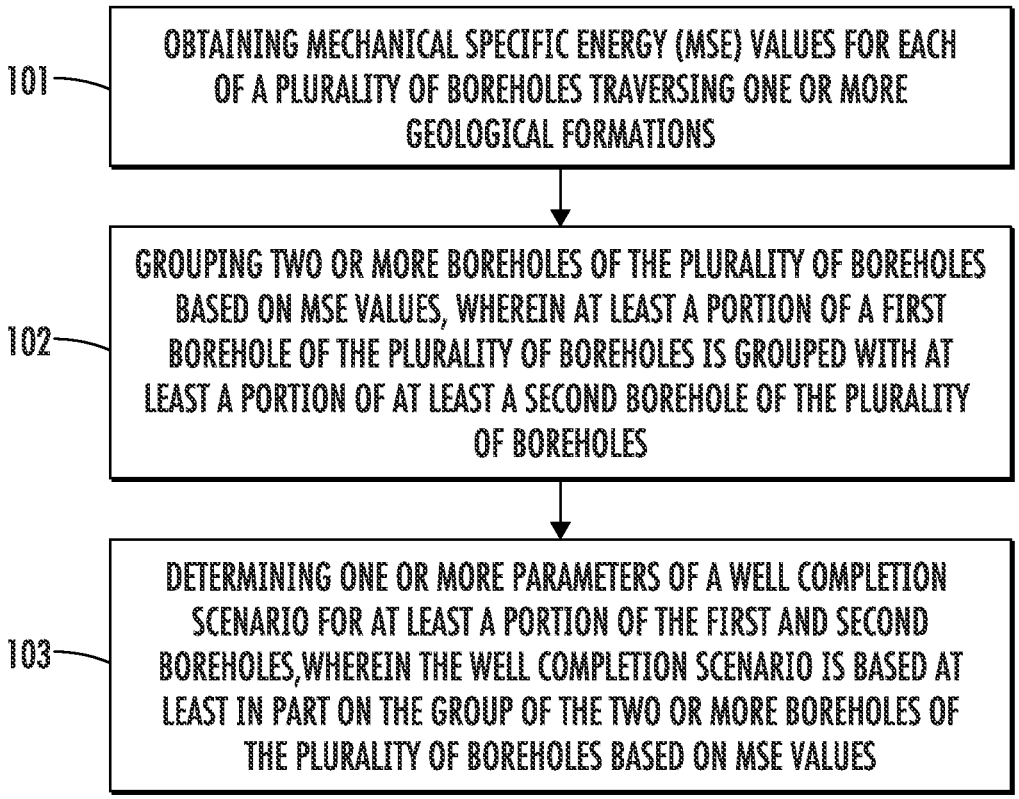
FIG. 1 illustrates a flow diagram for a method for grouping two or more boreholes in accordance with certain aspects of the subject matter described herein.

While the claimed subject matter is susceptible to various modifications and alternative forms, the drawing(s) illustrate specific embodiments herein described in detail by way of example. It should be understood, however, that the description herein of specific embodiments is not intended to limit the claimed subject matter to the particular forms disclosed, but on the contrary, the intention is to cover all modifications, equivalents, and alternatives falling within the spirit and scope as defined by the appended claims.

Definitions

To more clearly define the terms used in this disclosure, the following definitions are provided. Unless otherwise indicated, the following definitions are applicable to this disclosure. To the extent that any definition or usage provided by any document incorporated here by reference conflicts with the definition or usage provided herein, the definition or usage provided in this disclosure controls.

In this disclosure, features of the subject matter are described such that, within particular aspects, a combination of different features can be envisioned. For each and every aspect and each and every feature disclosed herein, all combinations that do not detrimentally affect the designs, apparatuses, systems, computer readable media, processes, or methods described herein are contemplated with or without explicit description of the particular combination. Additionally, unless explicitly recited otherwise, any aspect or feature disclosed herein can be combined to describe inventive designs, apparatuses, systems, computer readable media, processes, or methods consistent with the present disclosure.

In this disclosure, while systems methods, computer readable media are often described in terms of "comprising" various components or steps, the foregoing can also "consist essentially of" or "consist of" the various components or steps, unless stated otherwise. For example, a system consistent with aspects of the disclosed subject matter can comprise; alternatively, can consist essentially of; or alternatively, can consist of the various components, unless stated otherwise. As another example, a method consistent with aspects of the disclosed subject matter can comprise; alternatively, can consist essentially of; or alternatively, can consist of the various steps, unless stated otherwise.

The terms "a," "an," and "the" are intended to include plural alternatives, e.g., at least one, one or more, and one or more than one, unless otherwise specified.

The term "about" means that amounts, sizes, formulations, parameters, and other quantities and characteristics are not and need not be exact, but may be approximate including being larger or smaller, as desired, reflecting tolerances, conversion factors, rounding off, measurement errors, and the like, and other factors known to those of skill in the art. In general, an amount, size, formulation, parameter or other quantity or characteristic is "about" or "approximate" whether or not expressly stated to be such. Whether or not modified by the term "about," the claims include equivalents to the quantities.

Various numerical ranges are disclosed herein. When a range of any type is disclosed or claimed herein (e.g., "ranging from . . . ", "in the range of from . . . ", "in a range of from") the intent is to disclose or claim individually each possible number that such a range could reasonably encompass, including end points of the range as well as any sub-ranges and combinations of sub-ranges encompassed therein, unless otherwise specified. For example, the present disclosure, such as in FIG. 2, recites that MSE is in the range of from about 175 ksi-200 ksi in certain aspects. By a disclosure that the MSE can be in a range from about 175 ksi-200 ksi, the intent is to recite that the MSE can be any MSE within the range and, for example, can be equal to about 180 ksi, about 190 ksi, or about 200 ksi. Additionally, the MSE can be within any range from about 175 ksi to about 200 ksi (for example, the MSE can be in a range from about 185 ksi to about 195 ksi), and this also includes any combination of ranges between about 175 ksi to about 200 ksi. Likewise, all other ranges disclosed herein should be interpreted in a manner similar to this example.

Embodiments disclosed herein can provide the components listed as suitable for satisfying a particular feature of the embodiment delimited by the term "or." For example, a particular feature of the disclosed subject matter can be disclosed as follows: Feature X can be A, B, or C. It is also contemplated that for each feature the statement can also be phrased as a listing of alternatives such that the statement "Feature X is A, alternatively B, or alternatively C" is also an embodiment of the present disclosure whether or not the statement is explicitly recited.

The phrase "well completion scenario" as used herein means a plan proposed for at least some parts of the completion phase of a borehole.

All publications and patents mentioned herein are incorporated herein by reference for the purpose of describing and disclosing, for example, the constructs and methodologies that are described in the publications, which can be used in connection with the presently described subject matter.

DETAILED DESCRIPTION

Illustrative aspects of the subject matter claimed below will now be disclosed. In the interest of clarity, not all features of an actual implementation are described in this specification. It will be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The present disclosure is generally directed to one or more methods for grouping two or more boreholes based on MSE values, and related systems and computer readable media.

A. Methods

FIG. 1 illustrates a flow diagram for a method for grouping two or more boreholes in accordance with certain aspects of the disclosed subject matter. The method comprises (A) obtaining mechanical specific energy (MSE) values for each of a plurality of boreholes traversing one or more geological formations 101, (B) grouping two or more boreholes of the plurality of boreholes based on MSE values, wherein at least a portion of a first borehole of the plurality of boreholes is grouped with at least a portion of at least a second borehole of the plurality of boreholes 102, and (C) determining one or more parameters of a well completion scenario for at least a portion of the first and second boreholes, wherein the well completion scenario is based at least in part on the grouping of two or more boreholes of the plurality of boreholes based on MSE values 103. The method may also comprise completing or recompleting a plurality of wells based on the well completion scenario. For example, in some implementations the completing or recompleting of two or more wells occurs simultaneously or substantially simultaneously. Each of the method steps identified above are now discussed more fully below.

A1. Obtaining MSE Values

The MSE value of a particular facies within a particular geological formation is typically defined as the amount of energy required per unit volume of rock drilled, and can be calculated using drilling data that is recorded during the drilling of a borehole. Thus, MSE values for all of or certain portions of one or more boreholes traversing a particular geological formation (e.g., a plurality of boreholes at a or near a single pad) can be calculated using drilling data as an input. Drilling data includes without limitation information such as torque, RPM, hole diameter, ROP, and WOB. If a mud motor is used to drill the borehole, additional data can be recorded such as the speed-to-flow ratio, and differential pressure.

In some implementations, the MSE values can be calculated using a calculation method adopted by Pason Systems Corporation for use with its Electronic Drilling Recorder, which is described below and more fully in Pason Systems Corporation, MSE: A Valuable Trending Tool for Drillers and Engineers, PRODUCT APPLICATION NOTE.

The MSE calculation used by Pason provides that the absolute MSE can be calculated when the torque is calibrated and a mud motor is not in use with the following formula:

$$MSE = \frac{4 \cdot WOB}{\pi D^2} + \frac{480}{D^2} \cdot \frac{N \cdot T}{ROP} \quad \text{(Equation 1)}$$

The MSE calculation further provides that the MSE can be calculated provides when a mud motor is in use using the following formula:

$$MSE[ksi] = \frac{4 \cdot WOB}{\pi D^2} + \frac{480}{D^2} \cdot \frac{(N + K_N \cdot Q) \cdot ((T_{MAX}/\Delta P_{MAX}) \cdot \Delta P/1000)}{ROP} \quad \text{(Equation 2)}$$

The definitions and units associated with the variables or drilling data in the formulae above are shown below in Table 1.

TABLE 1

| Variable | Definition | US |
|---|---|---|
| MSE | Mechanical specific energy | ksi |
| WOB | Weight on bit | klbs |
| D | Bit diameter | inches |
| N | Rotary speed | RPM |
| T | Rotary torque (units may be different) | kFT-lb |
| ROP | Rate of penetration | ft/hr |
| $K_N$ | Mud motor speed to flow ratio | rev/gal |
| Q | Total mud flow rate | gal/min |
| $T_{MAX}$ | Mud motor maximum-rated torque | ft-lb |
| $P_{MAX}$ | Mud motor maximum-rated differential pressure | psi |
| P | Differential pressure | psi |

Although the above calculation method is preferred in some implementations, it should be appreciated that other calculation methods can be used that are capable of calculating or reasonably approximating the MSE. Such methods include without limitation the Teale definition, which is disclosed in an article entitled "The Concept Of Specific Energy In Rock Drilling" [Int'l J. Rock Mech. Mining Sci. (1965) 2, 5773]. The Teale definition uses drilling data such as weight-on-bit (WOB), rig rotary speed in RPM, torque at the bit, rate of penetration (ROP), and an area (i.e., borehole (or bit) cross-sectional area).

It has been found that MSE is closely related to the Uniaxial Compress Strength (UCS) or rock strength of one or more geological formations. Variation in the UCS is typically an indication of reservoir heterogeneity and change in facies of the geological rock formation. While MSE and UCS need not be necessarily equal, it has been found that they typically follow similar trends. Thus, by calculating the MSE, the UCS of the geological rock formation can be approximated, which permits estimation and/or mapping of the reservoir heterogeneity and change in facies of the geological formation traversed by one or more boreholes. In this manner, facies of the geological formation possessing the same or similar rock strength can be identified within a given portion of a respective borehole. In this connection, U.S. Patent Application Publication No. 2016/0017696 A1 discloses a method for analyzing drilling data to calculate MSE for a geological formation traversed by a borehole, and U.S. Pat. No. 10,837,277 discloses a well completion system and method in which MSE for a geological formation is utilized, both of which are incorporated here by reference in their entireties.

A2. Grouping at Least Two of the Boreholes

The method comprises grouping two or more boreholes of the plurality of boreholes based on MSE values, which may be accomplished in a variety of ways. For example, in some implementations, at least a portion of a first borehole of the plurality of boreholes is grouped with at least a portion of at least a second borehole of the plurality of boreholes. The grouping of the boreholes may be based on, at least in part, the portions of the first borehole and second borehole having the same or similar MSE values, which can be determined by a mapping of the MSE values of the one or more geological formations traversed by the first and second boreholes. In some implementations, the mapping of MSE values comprises categorizing the MSE values for each respective portion of the boreholes into a plurality of groups according to different ranges of MSE values, wherein the different ranges of MSE values represent different facies of rock. An exemplary categorization of MSE values of one or more boreholes for a target geological formation is shown in FIG. 2. It should be appreciated that the categorization of MSE values can depend on a variety of factors including without limitation the location of the target geological formation (e.g., Bakken, Eagle Ford and Permian Basin).

Figure 3:
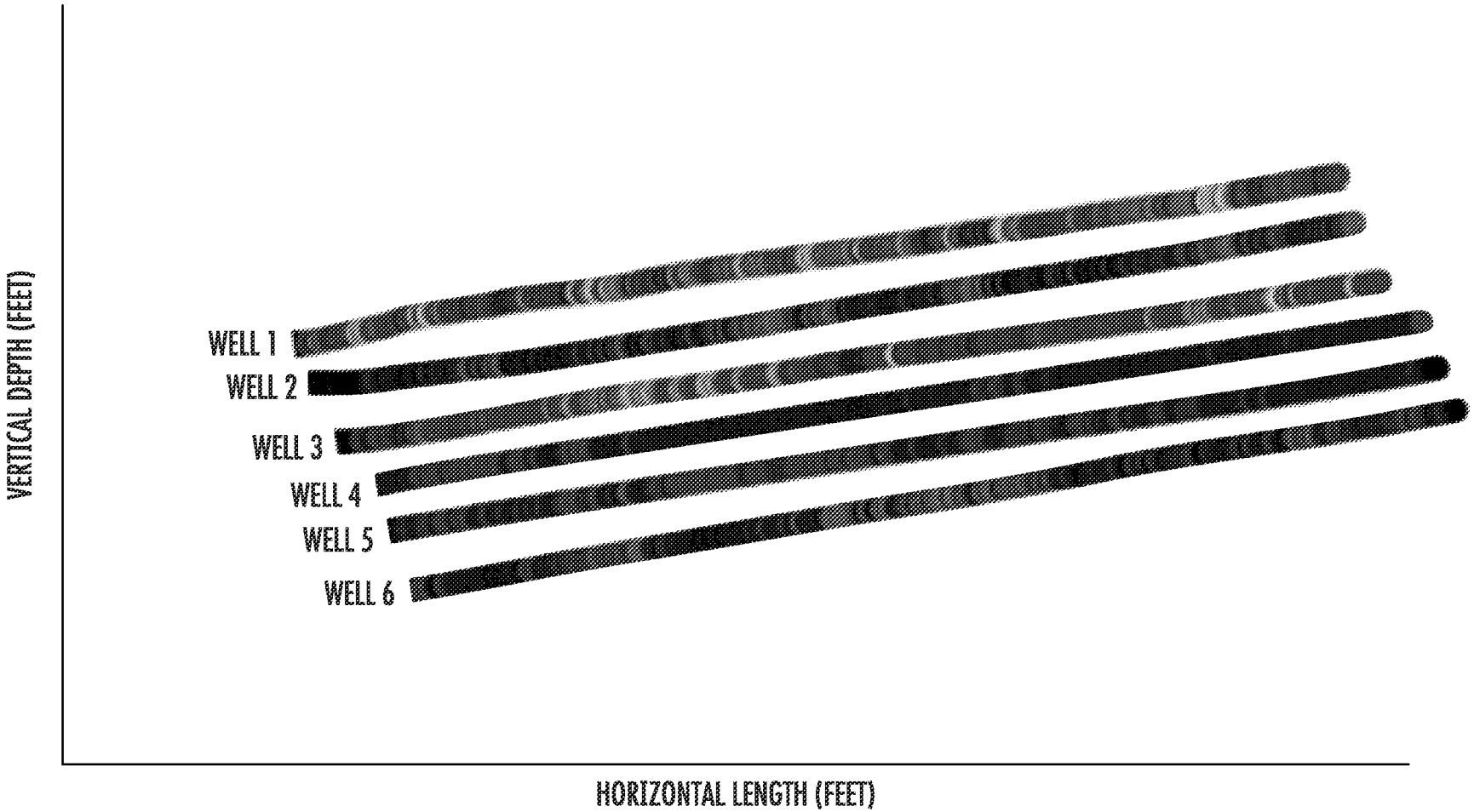
FIG. 3 illustrates a plotting or mapping of MSE values for a plurality of boreholes traversing a geological formation in accordance with certain aspects of the subject matter described herein.
Figure 4:
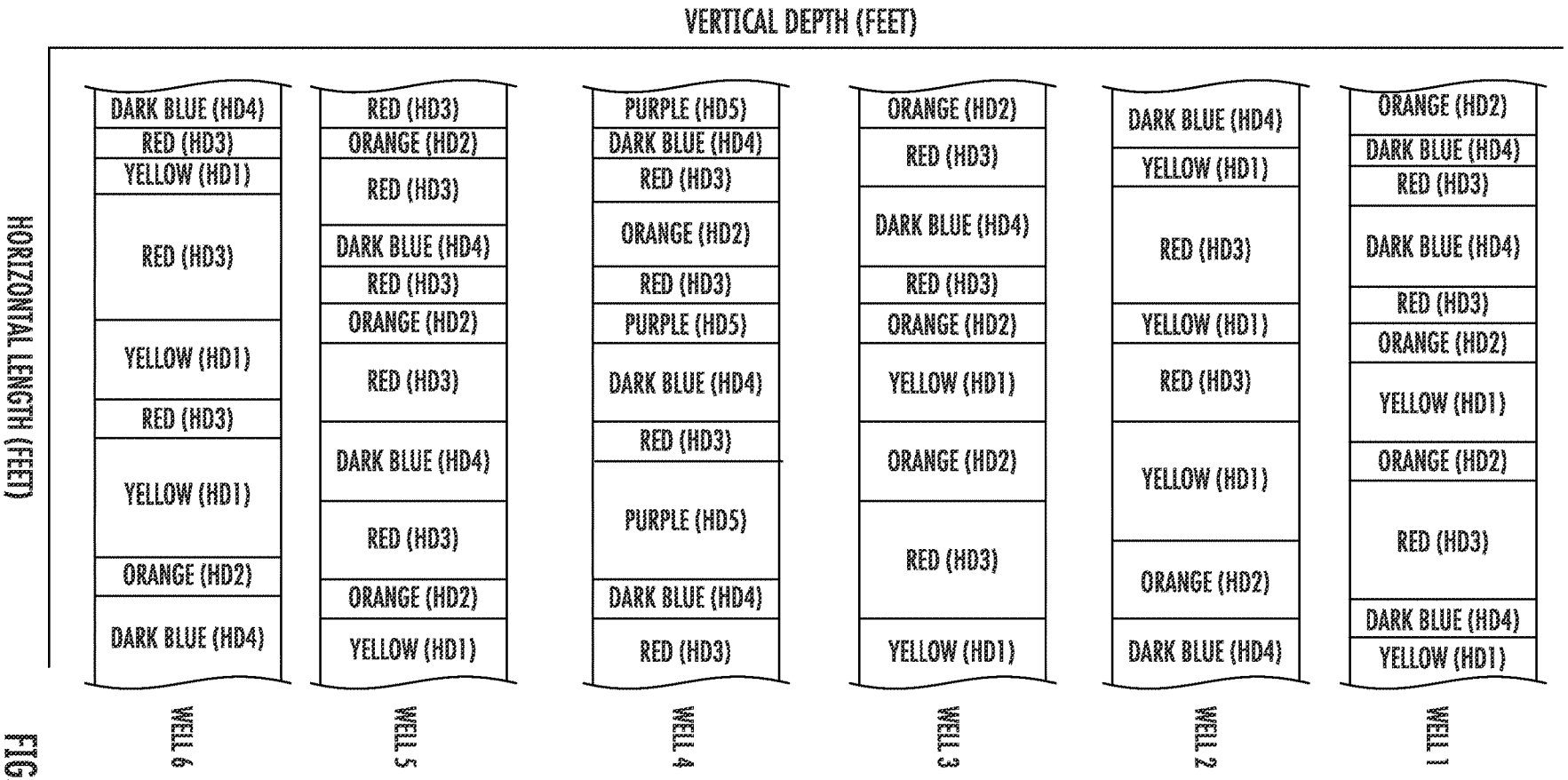
FIG. 4 illustrates a plotting or mapping of MSE values of selected portions of each of the boreholes shown in FIG. 3 in accordance with certain aspects of the subject matter described herein.
Figure 5:
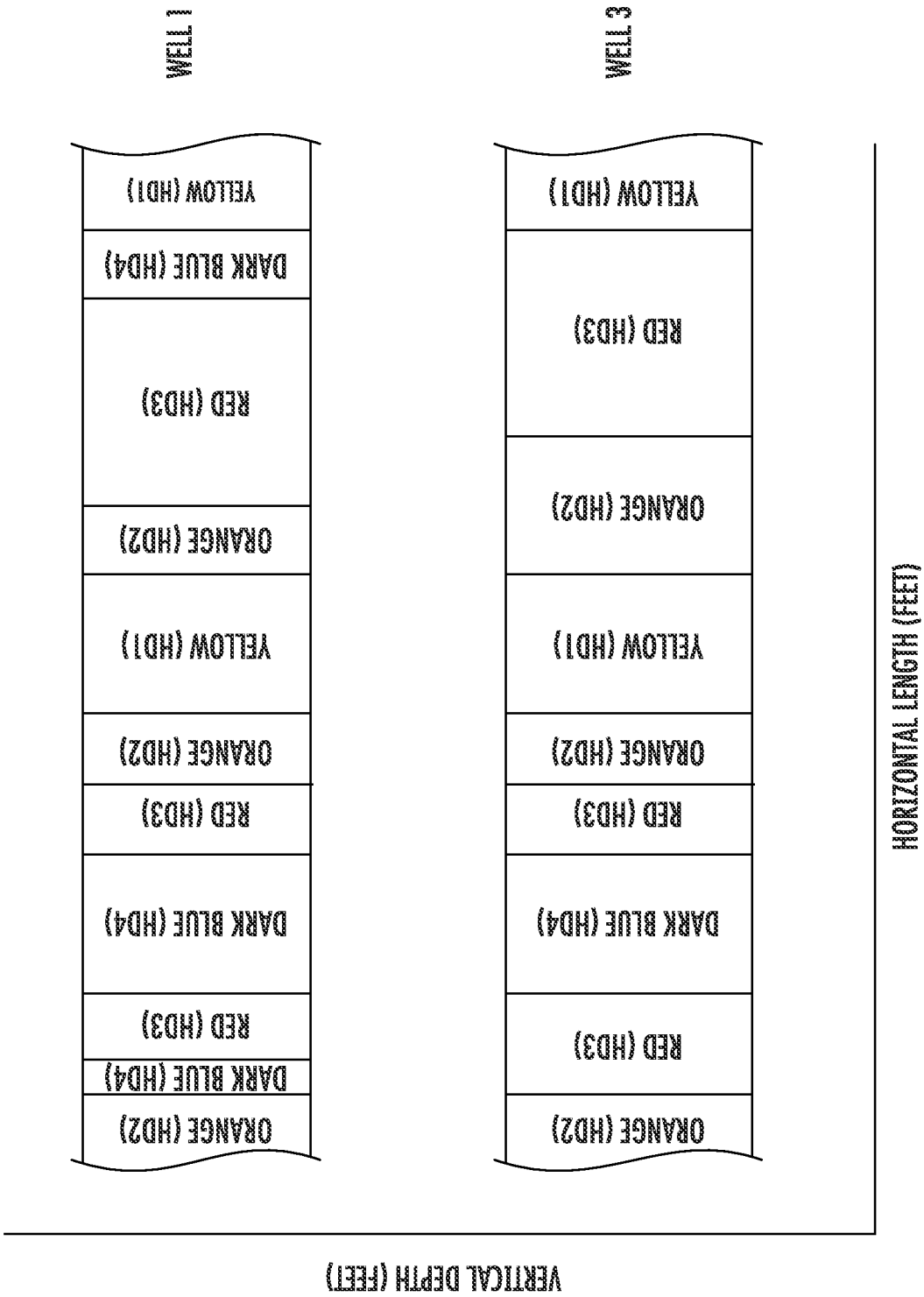
FIG. 5 illustrates a plotting or mapping of MSE values of selected portions of certain of the boreholes shown in FIG. 4 in accordance with certain aspects of the subject matter described herein.
Figure 6:
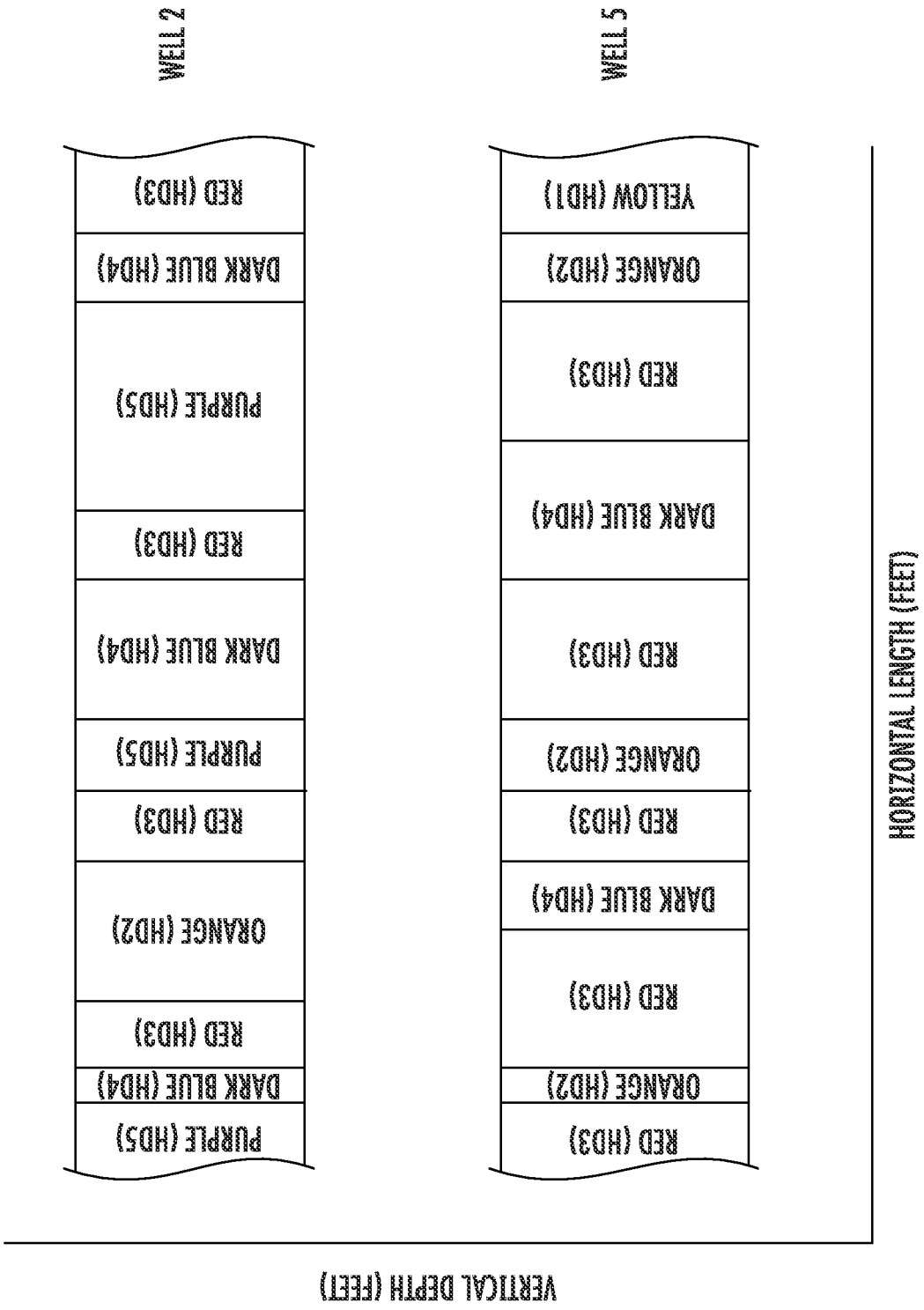
FIG. 6 illustrates a plotting or mapping of MSE values of selected portions of certain of the boreholes shown in FIG. 4 in accordance with certain aspects of the subject matter described herein.

As shown in FIG. 3, the mapping of MSE values may also comprise mapping or plotting groups to which the MSE values are categorized with locations along the portions of each respective borehole that are associated with the MSE values. Further in this connection, FIG. 4 illustrates a plotting or mapping of MSE values of selected portions of each of the boreholes shown in FIG. 3. FIGS. 5-6 illustrate a plotting or mapping of MSE values of selected portions of certain of the boreholes shown in FIG. 4 in which at least a portion of two or more boreholes are grouped together. For example, in FIG. 5 selected portions of two boreholes are grouped with one another based in part on a substantial homogeneity and/or low variability between the boreholes as shown by the plotting or mapping of the MSE values of the boreholes and as indicated by colors and/or hardness.

Figure 7:
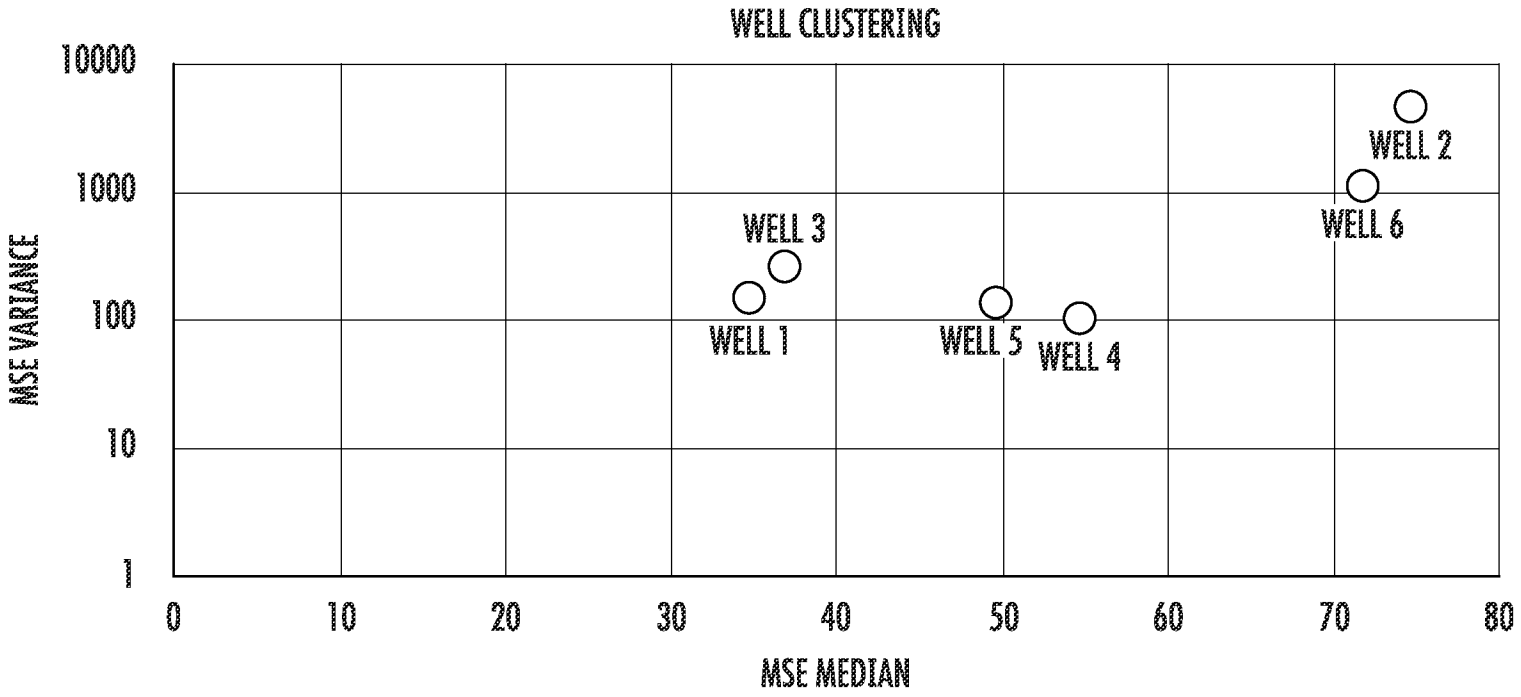
FIG. 7 illustrates a cluster analysis as performed with a cross-plot of MSE variance v. MSE Median in accordance with certain aspects of the subject matter described herein.
Figure 8:
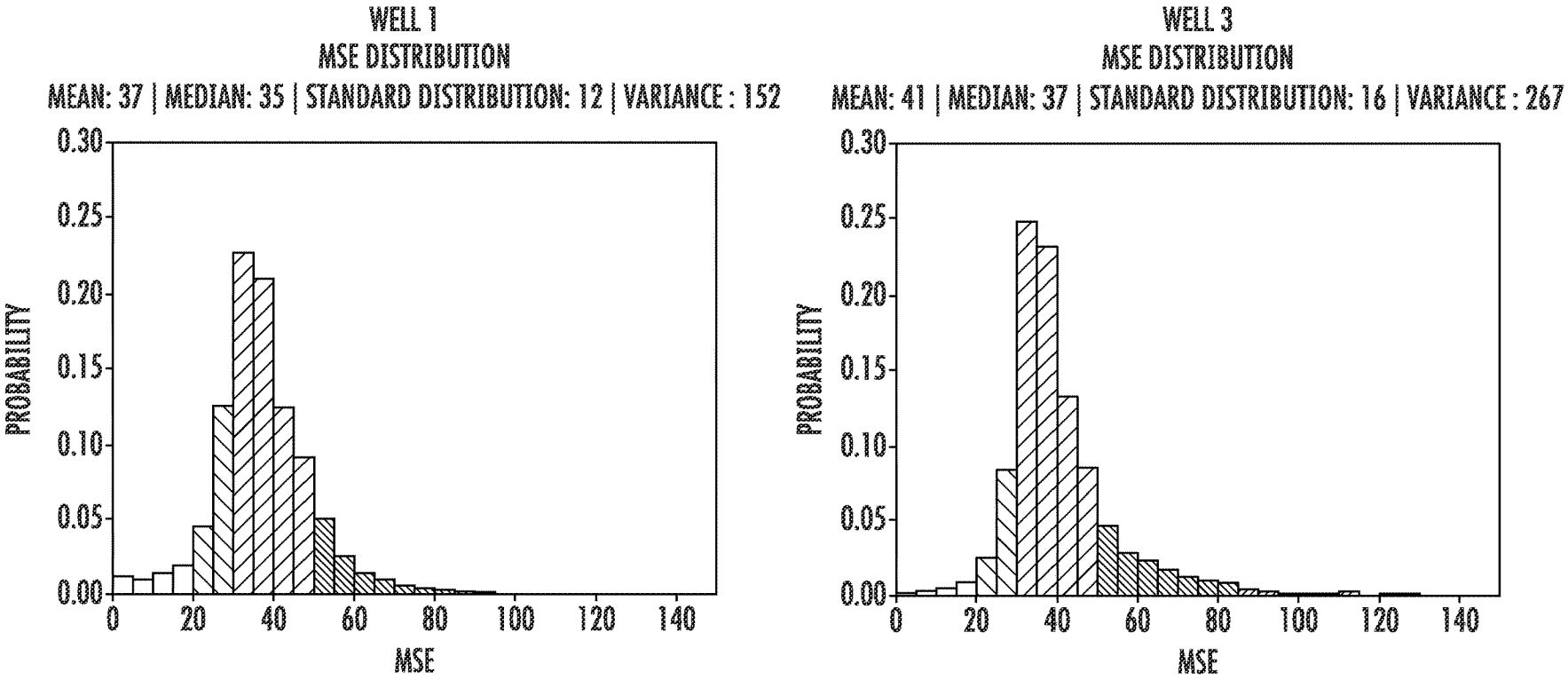
FIG. 8 illustrates an exemplary grouping of selected portions of two boreholes using the categorization of FIG. 2 and a quantitative statistical analysis employing shape of the cumulative MSE distribution curves of the selected portions of the boreholes in accordance with certain aspects of the subject matter described herein.
Figure 9:
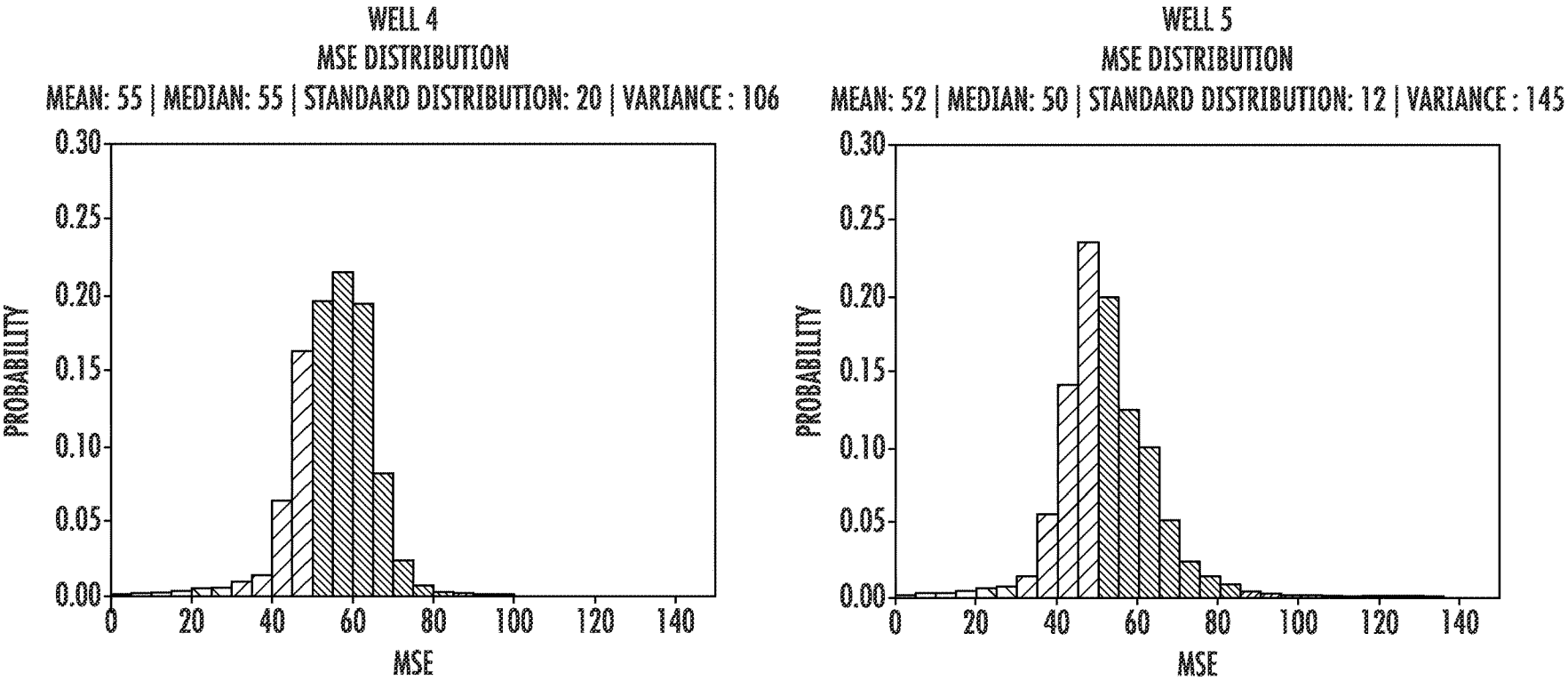
FIG. 9 illustrates an exemplary grouping of selected portions of two boreholes using the categorization of FIG. 2 and a quantitative statistical analysis employing shape of the cumulative MSE distribution curves of the selected portions of the boreholes in accordance with certain aspects of the subject matter described herein.
Figure 10:
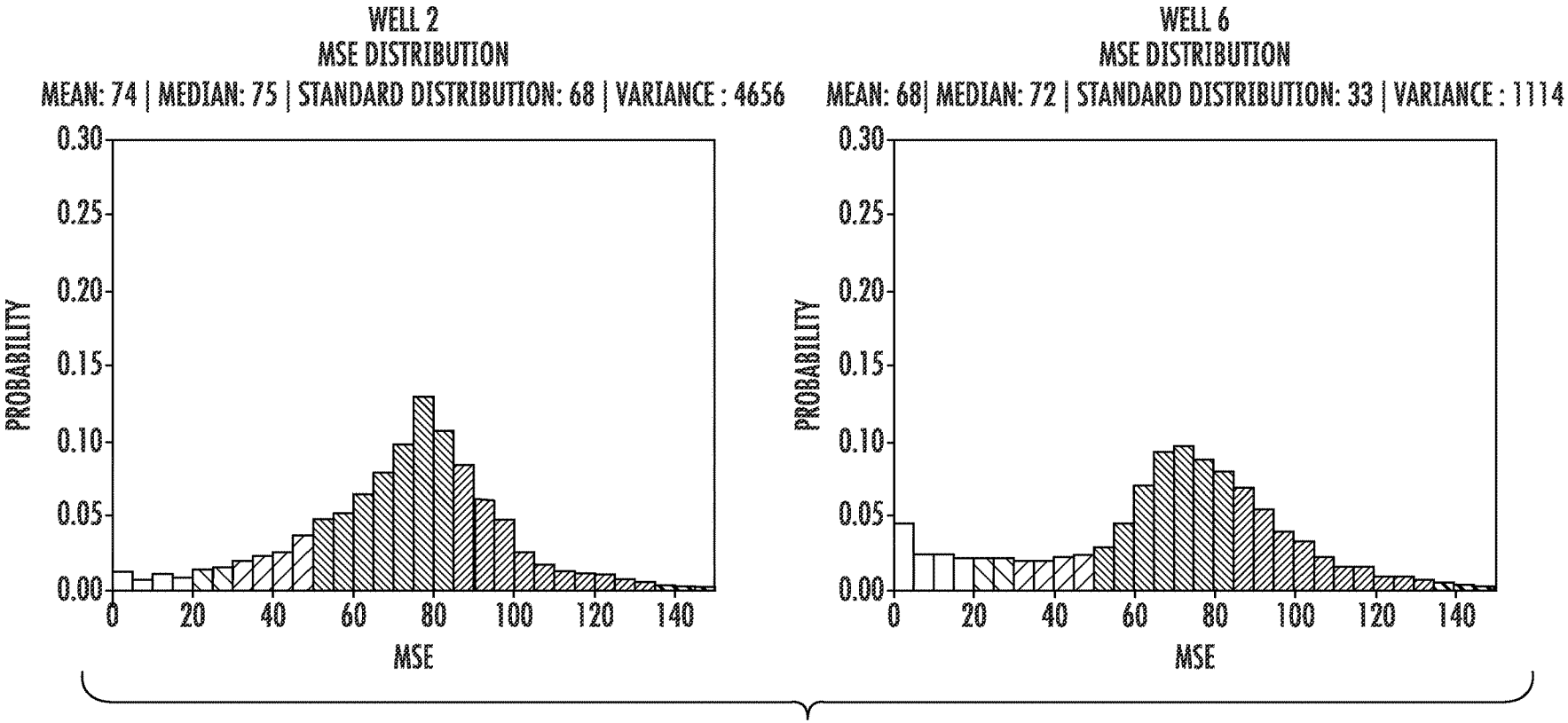
FIG. 10 illustrates an exemplary grouping of selected portions of two boreholes using the categorization of FIG. 2 and a quantitative statistical analysis employing shape of the cumulative MSE distribution curves of the selected portions of the boreholes in accordance with certain aspects of the subject matter described herein.

In some implementations, the grouping of two or more boreholes of the plurality of boreholes is at least in part based on grouping the portions of the first and second borehole having the same or similar MSE values as determined by a quantitative statistical analysis of the MSE values of the one or more geological formations traversed by the first and second boreholes. Examples of such quantitative statistical analysis methods include without limitation one selected from the group consisting of MSE average values, MSE standard deviation, MSE variance, MSE median, shape of the cumulative MSE distribution curve, and any combination of two or more of the foregoing. As an example and as shown in FIG. 7, the quantitative statistical analysis may comprise one or more a cluster analyses such those as performed with a cross-plot of MSE variance versus MSE Median. As another example, FIGS. 8-10 illustrate an exemplary grouping of selected portions of two boreholes using a quantitative statistical analysis in which the shape of the cumulative MSE distribution curves of the selected portions of the boreholes is employed. FIGS. 8-10 also include information additional quantitative statistical analyses that may be employed for grouping portions of two or more borehole such as, for example, MSE mean, MSE median, MSE standard deviation, and MSE variance. It should be appreciated that various numerical and statistical methods known in the art may be employed as the one or more quantitative analyses used in the methods described herein to assess sameness or similarity of MSE values of two or more boreholes traversing one or more geological formations.

In some implementations, the grouping of two or more boreholes is at least in part based on a grouping of the portions of the first and second boreholes having the same or similar MSE values as determined by a granular assessment of the MSE values of the one or more geological formations traversed by the first and second boreholes. In some aspects, the granular assessment comprises (a) categorizing the MSE values of each respective borehole into a plurality of groups according to different ranges of MSE values, wherein the different ranges of MSE values represent different facies of rock; and (b) comparing the groups to which the MSE values are categorized with locations along portions of each respective borehole which are associated with the MSE values so as to group particular portions of each respective borehole with one another. Such a granular assessment can be done visually, numerically, or both visually and numerically. FIG. 6 illustrates a scenario where such implementation of a granular assessment might be employed due to the presence of substantial heterogeneity and/or high variability between the boreholes as shown by the plotting or mapping of the MSE values of the boreholes and as indicated by colors and/or hardness.

It should be appreciated that the step of grouping of two or more boreholes may utilize any of the above described grouping steps, either alone or in combination. For example, in some implementations, the grouping of two or more boreholes is at least in part based on grouping (A) the portions of the first borehole and second borehole having the same or similar MSE values as determined by a mapping of the MSE values of the one or more geological formations traversed by the first and second boreholes, (B) the portions of the first and second borehole having the same or similar MSE values as determined by a quantitative statistical analysis of the MSE values of the one or more geological formations traversed by the first and second boreholes, (C) the portions of the first and second borehole having the same or similar MSE values as determined by a granular assessment of the MSE values of the one or more geological formations traversed by the first and second boreholes, or (D) any combination of two or more of the foregoing.

In this manner, two or more boreholes traversing one or more geological formations may be grouped in a way that takes into consideration possible differences in rock properties among the boreholes so as to minimize or reduce rock heterogeneity and/or variability between the grouped boreholes thereby resulting in a more optimum grouping. Such an optimal grouping should serve to promote more proportionate treatment fluid slurry (e.g., proppant+carrier fluid) flow split, for example, in well completion operations involving co-mingled injection of fluid slurry in two or more boreholes. This can result in more successful placement of designed volumes of proppant in each borehole. Additionally, it is believed that this can result in optimally distributed hydraulic fractures and ideal stimulated rock volumes among boreholes thereby enhancing productivity levels of natural resources from one or more geological formations.

As shown in FIG. 6, it should be appreciated that in some instances the step of grouping two or more boreholes using any of the above described grouping steps, either alone or in combination, may reveal that one or more portions of the grouped boreholes may still be likely to encounter issues during well completion, for example, treatment issues and/or highly uneven flowrate splits for commingled injection of proppant during a simultaneous hydraulic fracturing process, due to local incompatibility between MSE profiles that represent rock facies/strength corresponding to specific portions of grouped boreholes. Even in such cases, the step of grouping of two or more boreholes using any of the above described grouping steps allows for the development of contingency strategies on the front end, which can save time and money. Examples of such contingency strategies include without limitation local modification of the grouping of two or more boreholes, engineered placement of bridge plugs, engineered placement of perforation clusters in mechanically-comparable rock for a respective borehole (possibly resulting in improved cluster efficiency and improved injectivity), targeted application of chemicals (i.e. linear gels, x-linked gels, friction reducers, etc.) in a respective borehole, local adjustments of injection treatment schedules for a respective borehole, or any combination of two or more of the foregoing.

Further, it should also be appreciated that any proposed grouping of two or more boreholes based on MSE values should also consider the feasibility of such a grouping based on other considerations such as the hydraulics associated with a grouping of boreholes (e.g., differences in depth and geometry among respective boreholes). In some instances, such as where one borehole is significantly deeper than another borehole in a particular geological formation, a grouping of boreholes based solely on MSE may not be feasible. It should be appreciated that the hydraulics for a respective borehole grouping may be determined by a variety of calculation methods known in the art. As an example, the difference in treating pressure between two or more boreholes landed at different depths can be approximated to a purely hydrostatic column (e.g., 0.433 psi/ft). Thus, a vertical offset between two boreholes of about 500 feet should correspond to a pressure difference of about 216 psi, which can cause self-diversion and hinder the intended equal split of fluid slurry. On the other hand, a vertical offset between two boreholes of about 50 feet should correspond to a pressure difference of about 22 psi, which should be tolerable and thus should make the grouping of boreholes based on MSE values feasible.

A3. Determining at Least One Parameter of a Well Completion Scenario

The method comprises determining one or more parameters of a well completion scenario for at least a portion of the first and second boreholes. The well completion scenario is based at least in part on the step of grouping two or more boreholes of the plurality of boreholes based on MSE values, which is more fully described herein, and in particular in Section A2. The method may also comprise completing or recompleting a plurality of wells based on the well completion scenario, for example, completing or recompleting of each of the plurality of wells by hydraulic fracturing each of the grouped or selected boreholes simultaneously or substantially simultaneously.

It should be appreciated that the well completion scenario may comprise various design parameters such as those contemplated and discussed more fully in U.S. Pat. No. 10,837,277. For example, the well completion scenario may comprise perforating at least a portion of each respective borehole based on the well completion scenario. In some implementations, the well completion scenario comprises positioning at least one perforation cluster at a location along each respective borehole having the same or substantially similar facies as defined by the grouping of boreholes based on MSE values. In this manner, perforation clusters can be positioned at one or more length and/or depth point of each respective borehole with the same or substantially similar facies as determined by MSE values. Additionally, the well completion scenario can comprise optimizing various perforation parameters associated with perforating a respective borehole by utilizing the grouping of two or more boreholes based on MSE values. Examples of perforation parameters include without limitation the number of perforations per perforation cluster, the number of perforation clusters in a given stage of the borehole, the spacing of perforation clusters, the perforation charge type, or any combination of two or more of the foregoing.

In some implementations, the well completion scenario comprises determining a hydraulic fracturing fluid initiation pressure for at least a portion of each respective borehole. For example, by grouping portions of two or more boreholes together having the same or substantially similar facies as determined by MSE values, an optimum fluid initiation pressure can be determined. The fluid initiation pressure is typically understood as the fluid pressure within a respective borehole resulting in the initiation of a tensile crack in a defect free or substantially defect free subsurface material.

In some implementations, the well completion scenario can comprise optimizing one or more fracturing parameters based on the groping of boreholes based on MSE values. For example, the pump rate (e.g., gallons per minute) of the fracturing fluid during the hydraulic fracturing process can be optimized for a particular portion or stage of the borehole.

In some implementations, the well completion scenario can comprise selecting a hydraulic fracturing fluid based on the grouping of two or more boreholes based on MSE values. The well completion scenario can also include using the hydraulic fracturing fluid in the hydraulic fracturing process. In addition, one or more fracturing fluid parameters can also be optimized based on the grouping of boreholes based on MSE values. Examples of fracturing fluid parameters include without limitation fracturing fluid type, viscosity, rheology, pumping rate of fracturing fluid, or any combination of two or more of the foregoing. In addition, one or more fracturing fluid additives can also be selected and/or optimized using the grouping of two or more boreholes, e.g., types and volumes of polymers, breakers, acids, clay stabilizers, pH stabilizers, or any combination of two or more of the foregoing.

In some implementations, the well completion scenario comprises selecting a proppant for use in at least a portion of each respective borehole, and using the proppant in a hydraulic fracturing process. One or more additional proppant parameters can also be optimized based on the grouping of two or more boreholes based on MSE. Examples of additional proppant parameters include without limitation proppant size (i.e., mesh size), proppant type (e.g., white sand, ceramic, etc.), volume of proppant, or any combination of two or more of the foregoing.

In some implementations, the well completion scenario comprises positioning at least one fracture plug at a location along each respective borehole. A hydraulic fracturing process may be completed for at least a portion of the first borehole, the second borehole, or both of the foregoing. In the case of fracturing two or more boreholes, such hydraulic fracturing process may also be completed simultaneously or substantially simultaneously.

B. Computer Readable Media and Systems

B1. Computer Readable Media

It should be appreciated that the methods described in this disclosure may be implemented in hardware, software, or a combination thereof. In the context of software, the described methods may represent computer-executable instructions stored on one or more computer-readable media that, when executed by one or more processors perform the recited method steps. Generally, computer-executable instructions include routines, programs, objects, components, data structures, and the like that perform particular functions or implement particular abstract data types. The order in which the steps are described is not intended to be construed as a limitation, and any number of the described steps can be combined in any order and/or in parallel to implement a particular method.

Thus, in some implementations and as shown in FIG. 1, the one or more computer-readable media contain the computer-executable instructions stored thereon that, comprise at least the following steps:

- obtaining mechanical specific energy (MSE) values for each of a plurality of boreholes traversing one or more geological formations 101,
- grouping two or more boreholes of the plurality of boreholes based on MSE values, wherein at least a portion of a first borehole of the plurality of boreholes is grouped with at least a portion of at least a second borehole of the plurality of boreholes 102, and
- determining one or more parameters of a well completion scenario for at least a portion of the first and second boreholes, wherein the well completion scenario is based at least in part on the grouping of two or more boreholes of the plurality of boreholes based on MSE values 103.

It should be appreciated that the one or more computer-readable media may contain additional computer-executable instructions comprising additional steps such as those described herein, and in particular above in Sections A, A1, A2, and/or A3. For example, in some implementations, the computer-executable instructions can further include obtaining the MSE values by calculating the MSE values based on drilling data obtained for the plurality of boreholes.

The computer-readable media upon which is encoded machine-readable code should be suitable for storing computer program instructions and data. Examples of computer-readable media include without limitation tangible non-transitory computer-readable storage media such as, for example, hard drives, optical disks, CD-ROMs, DVDs, read-only memories (ROMs), random access memories (RAMs), EPROMS, EEPROMs, flash memory, magnetic or optical cards, solid-state memory devices, or other types of storage media suitable for storing electronic instructions. In addition, in some implementations, the computer-readable media may include a transitory computer-readable signal (in compressed or uncompressed form). Examples of computer-readable signals, whether modulated using a carrier or not, include, but are not limited to, signals that a computer system hosting or running a computer program can be configured to access, including signals downloaded through the Internet or other suitable networks.

B2. Systems

In some implementations such as in the context of hardware, the methods described herein may represent computer-executable instructions stored on a system comprising one or more processors and one or more computer-readable media that upon which is encoded machine-readable code that when executed by the processor is configured so that the system carries out one or more of the methods described herein. The one or more processors suitable for the execution of machine-readable code such as a computer program may include both general and special purpose microprocessors, and any processors of any kind of digital computer.

Thus, in some implementations and as shown in FIG. 1, the method executed by the system comprises at least the following steps:

obtaining mechanical specific energy (MSE) values for each of a plurality of boreholes traversing one or more geological formations 101, grouping two or more boreholes of the plurality of boreholes based on MSE values, wherein at least a portion of a first borehole of the plurality of boreholes is grouped with at least a portion of at least a second borehole of the plurality of boreholes 102, and determining one or more parameters of a well completion scenario for at least a portion of the first and second boreholes, wherein the well completion scenario is based at least in part on the grouping of two or more boreholes of the plurality of boreholes based on MSE values 103.

It should be appreciated that the system may contain additional computer-executable instructions causing the system to carry out additional steps such as those described herein, and in particular above in Sections A, A1, A2, and/or A3. For example, in some implementations, the computer-executable instructions can further include obtaining the MSE values by the system calculating the MSE values based on drilling data obtained for the plurality of boreholes.

The subject matter is described above with reference to numerous aspects and specific examples. Many variations will suggest themselves to those skilled in the art in light of the above detailed description. All such obvious variations are within the full intended scope of the appended claims. Other aspects of the subject matter disclosed herein can include, but are not limited to, the following (aspects are described as "comprising" but, alternatively, can "consist essentially of", or "consist of"):

Aspect 1. A method comprising obtaining mechanical specific energy (MSE) values for each of a plurality of boreholes traversing one or more geological formations; grouping two or more boreholes of the plurality of boreholes based on MSE values, wherein at least a portion of a first borehole of the plurality of boreholes is grouped with at least a portion of at least a second borehole of the plurality of boreholes; and determining one or more parameters of a well completion scenario for at least a portion of the first and second boreholes, wherein the well completion scenario is based at least in part on the grouping of two or more boreholes of the plurality of boreholes based on MSE values.

Aspect 2. A method as defined by Aspect 1, wherein the MSE values are obtained by calculating MSE based on drilling data for the plurality of boreholes.

Aspect 3. A method as defined by any of Aspects 1-2, wherein the grouping of two or more boreholes is at least in part based on grouping the portions of the first borehole and second borehole having the same or similar MSE values as determined by a mapping of the MSE values of the one or more geological formations traversed by the first and second boreholes.

Aspect 4. A method as defined by Aspect 3, wherein the mapping of MSE values comprises (a) categorizing the MSE values for each respective portion of the boreholes into a plurality of groups according to different ranges of MSE values, wherein the different ranges of MSE values represent different facies of rock; and (b) mapping groups to which the MSE values are categorized with locations along the portions of each respective borehole that are associated with the MSE values.

Aspect 5. A method as defined by any of Aspects 1-4, wherein the grouping of two or more boreholes is at least in part based on grouping the portions of the first and second borehole having the same or similar MSE values as determined by one selected from the group consisting of MSE average values, MSE standard deviation, MSE variance, MSE median, shape of the cumulative MSE distribution curve, and any combination of two or more of the foregoing.

Aspect 6. A method as defined by any of Aspects 1-5, wherein the grouping of two or more boreholes is at least in part based on a grouping of the portions of the first and second borehole having the same or similar MSE values as determined by a quantitative statistical analysis of the MSE values of the one or more geological formations traversed by the first and second boreholes.

Aspect 7. A method as defined by Aspect 6, wherein the quantitative statistical analysis comprises a cluster analysis as performed with a cross-plot of MSE variance versus MSE Median.

Aspect 8. A method as defined by any of Aspects 1-7, wherein the grouping of two or more boreholes is at least in part based on a grouping of the portions of the first and second borehole having the same or similar MSE values as determined by a granular assessment of the MSE values of the one or more geological formations traversed by the first and second boreholes.

Aspect 9. A method as defined by Aspect 8, wherein the granular assessment comprises (a) categorizing the MSE values of each respective borehole into a plurality of groups according to different ranges of MSE values, wherein the different ranges of MSE values represent different facies of rock; and (b) comparing the groups to which the MSE values are categorized with locations along portions of each respective borehole which are associated with the MSE values so as to group particular portions of each respective borehole with one another.

Aspect 10. A method as defined by any of Aspects 1-2, wherein the grouping of two or more boreholes is at least in part based on grouping: (A) the portions of the first borehole and second borehole having the same or similar MSE values as determined by a mapping of the MSE values of the one or more geological formations traversed by the first and second boreholes; (B) the portions of the first and second borehole having the same or similar MSE values as determined by a quantitative statistical analysis of the MSE values of the one or more geological formations traversed by the first and second boreholes; (C) the portions of the first and second borehole having the same or similar MSE values as determined by a granular assessment of the MSE values of the one or more geological formations traversed by the first and second boreholes; or (D) any combination of two or more of the foregoing.

Aspect 11. A method as defined by any of Aspects 1-10, wherein the method comprises completing or recompleting a plurality of wells based on the well completion scenario.

Aspect 12. A method as defined by Aspect 11, wherein the completing or recompleting of each of the plurality of wells occurs simultaneously or substantially simultaneously.

Aspect 13. A method as defined by any of Aspects 1-11, wherein the well completion scenario comprises positioning at least one perforation cluster at a location along each respective borehole having the same or substantially similar facies as defined by the grouping of MSE values.

Aspect 14. A method as defined by Aspect 13, wherein the method comprises perforating at least a portion of each respective borehole based on the well completion scenario.

Aspect 15. A method as defined by any of Aspects 1-14, wherein the well completion scenario comprises determining a hydraulic fracturing fluid initiation pressure for at least a portion of each respective borehole.

Aspect 16. A method as defined by any of Aspects 1-15, wherein the well completion scenario comprises selecting a proppant for use in at least a portion of each respective borehole.

Aspect 17. A method as defined by any of Aspects 1-16, wherein the well completion scenario comprises positioning at least one fracture plug at a location along each respective borehole.

Aspect 18. A method as defined by any of Aspects 1-17, wherein the well completion scenario comprises selecting a hydraulic fracturing fluid for use in at least a portion of each respective borehole, and using the hydraulic fracturing fluid in a hydraulic fracturing process.

Aspect 19. A method as defined by any of Aspects 1-18, wherein the method comprises fracturing at least a portion of the first borehole, the second borehole, or both of the foregoing.

Aspect 20. A non-transitory computer-readable medium having computer executable instructions that, when executed by at least one processor, cause the processor to perform a method as defined by any of Aspects 1-19.

Aspect 21. A system comprising at least one processor; and one or more tangible non-transitory computer readable storage media upon which is encoded machine-readable code that when executed is configured so that the system carries out a method as defined by any of Aspects 1-19.

What is claimed is:

1. A method comprising:

obtaining mechanical specific energy (MSE) values for each of a plurality of boreholes traversing one or more geological formations:

grouping two or more boreholes of the plurality of boreholes based on MSE values, wherein at least a portion of a first borehole of the plurality of boreholes is grouped with at least a portion of at least a second borehole of the plurality of boreholes;

determining one or more parameters of a well completion scenario for at least a portion of the first and second boreholes, wherein the well completion scenario is based at least in part on the grouping of two or more boreholes of the plurality of boreholes based on MSE values, wherein the grouping of two or more boreholes is at least in part based on a grouping of the portions of the first and second borehole having the same or similar MSE values as determined by a quantitative statistical analysis of the MSE values of the one or more geological formations traversed by the first and second boreholes, and wherein the quantitative statistical analysis comprises a cluster analysis as performed with a cross-plot of MSE variance versus MSE Median; and completing or recompleting a plurality of wells based on the well completion scenario.

2. The method of claim 1 wherein the completing or recompleting of each of the plurality of wells occurs simultaneously or substantially simultaneously.

3. The method of claim 1 further comprising fracturing at least a portion of the first borehole, the second borehole, or both of the foregoing.

4. The method of claim 1, wherein the well completion scenario comprises selecting a hydraulic fracturing fluid for use in at least a portion of each respective borehole, and using the hydraulic fracturing fluid in a hydraulic fracturing process.

5. The method of claim 1 wherein the well completion scenario comprises:

a) positioning at least one perforation cluster at a location along each respective borehole having the same or substantially similar facies as defined by the grouping of MSE values;

b) determining a hydraulic fracturing fluid initiation pressure for at least a portion of each respective borehole;

c) selecting a proppant for use in at least a portion of each respective borehole; and/or d) positioning at least one fracture plug at a location along each respective borehole.

6. The method of claim 5 wherein the method in a) comprises perforating at least a portion of each respective borehole based on the well completion scenario.

* * * * *